US005833050A

United States Patent [19]

Takagi et al.

[11] Patent Number: 5,833,050

[45] Date of Patent: Nov. 10, 1998

[54] KEYSWITCH DEVICE

[75] Inventors: Takeyuki Takagi, Nagoya; Isao Mochizuki, Gifu-ken, both of Japan

[73] Assignee: Brother Kogyo Kabushiki Kaisha, Nagoya, Japan

[21] Appl. No.: 730,992

[22] Filed: Oct. 29, 1996

Related U.S. Application Data

[63] Continuation of Ser. No. 495,076, Jun. 27, 1995, abandoned.

[30] Foreign Application Priority Data

Jul. 20, 1994 [JP] Japan ..... 6-190991
Jul. 20, 1994 [JP] Japan ..... 6-190992

[51] Int. Cl.[6] ..... H01H 13/70

[52] U.S. Cl. ..... 200/344; 200/341; 200/512

[58] Field of Search ..... 200/341, 342, 200/343, 344, 345, 520, 512

[56] References Cited

U.S. PATENT DOCUMENTS

| | | | |
|---|---|---|---|
| 4,580,022 | 4/1986 | Oelsch | 200/344 |
| 5,141,343 | 8/1992 | Roylance et al. . | |
| 5,268,545 | 12/1993 | Bruner . | |
| 5,278,372 | 1/1994 | Takagi et al. . | |
| 5,280,147 | 1/1994 | Mochizuki et al. . | |
| 5,329,084 | 7/1994 | Watanabe et al. . | |
| 5,382,762 | 1/1995 | Mochizuki . | |
| 5,424,516 | 6/1995 | Emmons . | |
| 5,457,297 | 10/1995 | Chen | 200/344 |
| 5,463,195 | 10/1995 | Watanabe et al. . | |
| 5,466,901 | 11/1995 | Mochizuki . | |
| 5,519,569 | 5/1996 | Sellers . | |
| 5,532,904 | 7/1996 | Sellers . | |

FOREIGN PATENT DOCUMENTS

| | | |
|---|---|---|
| 543 649 | 5/1993 | European Pat. Off. . |
| 691 601 | 1/1996 | European Pat. Off. . |
| 3-10307 | 1/1991 | Japan . |
| 5-80880 | 4/1993 | Japan . |
| 5 069 831 | 9/1993 | Japan . |
| 5-69831 | 9/1993 | Japan . |
| 5-290673 | 11/1993 | Japan . |
| 5-298000 | 11/1993 | Japan . |
| 5-342943 | 12/1993 | Japan . |

OTHER PUBLICATIONS

Patent Abstracts of Japan, vol. 017, No. 296 (P–1551), Jun. 7, 1993 and JP 5019923, Jan. 29, 1993 Abstract.
Patent Abstracts of Japan, vol. 018, No. 100 (P–1695), Feb. 17, 1994 and JP 5298000, Nov. 12, 1993 Abstract.
Patent Abstracts of Japan, vol. 018, No. 167 (E–1528), Mar. 22, 1994 and JP 5342943, Dec. 24, 1993 Abstract.

*Primary Examiner*—David J. Walczak
*Attorney, Agent, or Firm*—Oliff & Berridge, PLC

[57] ABSTRACT

A keyswitch device is provided in which a key top is kept at an operation position when a key operation is carried out and is locked at a non-operation position lower than the operation position, thereby keeping high key operation performance while reducing the thickness and thus improving its portability. In this keyswitch device, the key top 2 is disposed to be movably upward and downward on a holder member 4 through a guide member 3, which supports a first link member 10 and a second link member 11 to be mutually rotatable. A circuit board 6 is fixed to a rubber spring 5 on which a base portion 12 of the first link member 10 of the guide member 3 is mounted is designed to be slidable on a support plate 7 in the opening and closing direction of the first link member 10 and the second link member 11 between the operation position and the non-operation position of the key top 2 through an operation knob 27. With this construction, thinning of the keyswitch device 1 can be accomplished. When the keyswitch device 1 is carried, the circuit board 6 is slid to the non-operation position to shift the rubber spring 5 to the non-operation position where it is separated from the guide member 3. Thereby, the guide member 3 is released from being biased by the rubber spring 5, and the first link member 10 and the second link member 11 are folded, so that the height of the key top 2 can be reduced.

60 Claims, 8 Drawing Sheets

KEYSWITCH DEVICE

This is a Continuation of application Ser. No. 08/495,076 filed Jun. 27, 1995, now abandoned.

BACKGROUND OF THE INVENTION

1. Field of the Invention

The present invention relates to a keyswitch device used for a keyboard provided on thin electronic equipment, such as a notebook-type word processor, personal computer or the like. This invention is particularly related to a keyswitch device in which an upward and downward movement of a key top is guide-supported by a guide support member for supporting two link members so as to be mutually rotatable. A switching member, on which the guide support member is mounted, is slidably disposed to hold the key top at an operation position when a key operation is carried out and to lock the key top at a non-operation position lower than the operation position during transport, thereby keeping high key-operation performance and improving portability.

2. Description of the Related Art

The notebook-type word processor has recently become very popular because of its excellent portability as it can be easily carried and operated anywhere. As a result, various attempts have been made to further improve the portability of the word processor.

For example, Japanese Laid-open Patent Application No. Hei-5-298000 proposes a keyboard device mounted in a notebook-type word processor in which the height of a key top is made variable by disposing a slide mechanism for sliding interlockingly during an opening and closing operation of a lid. A plate spring sheet is formed integrally of a return spring for elastically supporting the key top, and a contact press spring is switched by pushing a contact point of a membrane switch. This Japanese Application also proposes a keyboard device mounted in a notebook-type word processor or the like in which the height of a key top is made variable by disposing a shift mechanism with which a keyswitch base for supporting a key top that is movable upward and downward can be shifted upwardly and downwardly.

Furthermore, Japanese Laid-open Utility Model Application No. Hei-5-69831 discloses a keyswitch structure mounted in a notebook-type personal computer or the like, in which when a key operation is performed, a key top supported movably upwardly and downward on a keyboard frame is elastically urged through a contact portion of a plate spring to be held at a key operation position. When it is carried, a movable fulcrum member, which is disposed slidably on the keyboard frame, is slid to release engagement with a groove portion of a plate spring, whereby the urging of the key top by the contact portion of the plate spring is released to lower the height of the key top.

In both the keyboard and the keyswitch structure as disclosed by the above publications, the height of the key top is reduced during transport to improve the portability.

However, for the keyboard as disclosed in the respective publications described above, the height of the key top is made variable between the key operation time and the transport time to improve portability. In all these keyswitches, a key support member is used to support the key top to be movably upward and downward. In the keyswitch of the keyboard as described in the Japanese Laid-open Patent Application No. Hei-5-298000, the key top is supported to be movably upward and downward through a key stem portion formed in a switch housing or keyswitch base. Furthermore, in the keyswitch structure as described in Japanese Laid-open Utility Model Application No. Hei-5-69831, the key top is supported to be movably upward and downward through a silo (corresponding to a key stem portion) formed on a keyboard frame.

As described above, in the structure wherein the key top is supported through the key stem portion in the key support member, it is generally difficult to make the keyswitch thin at key operation time. For example, whether the keyswitch can be made thinner is greatly dependent on the length of the stem portion for slidably guiding the key top. Thus, the length of the stem portion is limited to a prescribed value to accomplish the thinning of the keyswitch. On the other hand, a stroke amount of the key top must be set to a prescribed value or more to keep excellent operation performance of the key top. Accordingly, if the stroke amount of the key top is set to be large while the keyswitch is thinned, the slide length of the stem portion becomes insufficient because the length of the stem portion cannot be set to be larger than a prescribed value. Therefore, when the key top is pressed, the key top and the stem portion are twisted with each other when the key top is pressed, so that the key top cannot be smoothly operated.

Various proposals have been hitherto made to solve the above problem. For example, in Japanese Laid-open Patent Application No. Hei-5-342943 and U.S. Pat. No. 5,280,147, a push button switch and a keyswitch device are described in which a key top is guide-supported through a holding member that supports two link members to be mutually rotatable. The holding member is directly secured to a housing or holder member having no stem portion. In this kind of switch, since no stem portion is formed in the housing or holder member to which the holding member of the key top is secured, there is no restriction based on the length of the stem portion. Thus, the thinning of the whole construction of the switch can be promoted.

When the switch as described in the Japanese Laidopen Patent Application No. Hei-5-342943 and U.S. Pat. No. 5,280,147 is used in a notebook-type word processor or the like, a mechanism for further lowering the height of the key top during transport is preferable to improve the portability. However, the slide mechanism of the plate spring sheet as described in the Japanese Laid-open Patent Application No. Hei-5-298000 and the slide mechanism of the movable fulcrum member as described in Japanese Laid-open Utility Model Application No. Hei-5-69831 have been proposed in view of the specific structures of their respective keyswitches. Thus, these mechanisms cannot be directly applied to the switches described in the Japanese Laid-open Patent Application No. Hei-5-342943 and the U.S. Pat. No. 5,280,147 in which the upward and downward movement of the key top is guide-supported by the holding member comprising two link members. As described above, for a switch in which the upward and downward movement of the key top is guide-supported by a holding member comprising two link members, an attempt to further lower the height of the key top and improve the portability during transport has not yet been hitherto made.

SUMMARY OF THE INVENTION

An object of the embodiments of the present invention is to provide a keyswitch device in which the upward and downward movement of a key top is guide-supported through a guide support member for supporting two link members to be mutually rotatable. A switching member on which the guide support member is mounted is disposed to be slidable to thereby hold the key top at an operation position when a key operation is carried out and to lock the key top at a non-operation position lower than the operation position during transport. Thus, a high key-operation performance can be maintained and portability can be improved while effectively thinning the device.

In order to attain the above and other objects, a keyswitch device according to the embodiment of this invention comprises a key top having a first holding portion and a second holding portion formed on the back surface thereof. A holder member having a third holding portion is disposed at the lower side of the key top to confront the first holding portion. A fourth holding portion is disposed to confront the second holding portion. A guide support member is provided comprising a first link member held by the first holding portion and the fourth holding portion and a second link member held by the second holding portion and the third holding portion. Both the first link member and the second link member are mutually rotatably supported through a shaft support portion to perform an opening and closing operation, thereby guiding an upward and downward movement of the key top. A circuit board is disposed at the lower side of the guide support member and has a switching electrode. A switching member is provided on the circuit board in correspondence to the switching electrode, and the guide support member is elastically mounted thereon to perform a switching operation in correspondence to the upward and downward movement of the key top. The circuit board is designed to be slidable together with the switching member in such a direction that the first link member and the second link member in the guide support member are opened between an operation position of the key top at which the guide support member is mounted on the switching member and a non-operation position of the key top at which the guide support member is detached from the switching member, which is lower than the operation position.

The keyswitch device is preferably provided with a stopper formed in the switching member and a holding groove formed in the second link member. The stopper is inserted into and engaged with the holding groove when the circuit substrate is slid toward the non-operation position. Furthermore, the key top preferably comprises a first portion of predetermined length with respect to the shaft support portion, and a second portion longer than the first portion. The switching member is positioned at the lower side of the second portion at the non-operation position. Still further, the switching member preferably comprises a rubber spring having a variable electrode that short-circuits the switching electrode. Each of the rubber spring and the guide support member is formed with a chamfer upwardly slanted from the operation position toward the non-operation position at a contact portion where the rubber spring and the guide support member mutually contact with each other.

In the keyswitch device thus constructed according to the present invention, when the key top is pressed to perform the key operation of the key top, the first link member and the second link member in the guide support member are mutually opened through the press of the key top because these members are mutually rotatably supported through the shaft support portion. Whereby, the key top is guided to be shifted downwardly.

The guide support member is also shifted downwardly in correspondence to the downward shift of the key top. On the basis of this shift, it performs a switching operation with the switching electrode formed on the circuit board through the switching member. Furthermore, when the press of the key top is released, the above operation is inversely carried out among the first link member, the second link member, the key top and the holder member. The key top is upwardly urged by an elastic force of the switching member while the first link member and the second link member are mutually closed, so that it returns to the original position.

When the keyswitch device is carried, the circuit board on which the switching member is disposed is slid in such a direction that the first link member and the second link member are opened. Whereby, the key top is shifted from the operation position where the guide support member is mounted on the switching member to the non-operation position, which is lower than the operation position, and where the guide support member is detached from the switching member. As a result, the height of the key top is lowered, and the portability is improved.

When the stopper is formed in the switching member, the holding groove for engagedly holding the stopper is formed in the second link member, and the stopper is engagedly inserted into the holding groove when the circuit board is slid toward the non-operation position of the key top. Thus, the key top is held at the non-operation position that is lower than its operation position through the stopper and the holding groove. Accordingly, the key top is surely locked at the non-operation position when the keyswitch device is carried. Thus, it can be prevented from rotating and shifting while it is carried. Furthermore, when the keyswitch device is designed so that the key top comprises a first portion and a second portion, which is longer than the first portion with respect to the shaft support portion, and the switching member is positioned at the lower side of the second portion at the non-operation position of the key top, the switching member can be efficiently accommodated at the lower side of the key top by effectively using a space formed at the lower side of the second portion.

Furthermore, the switching member comprises a rubber spring having a variable electrode, and each of the rubber spring and the guide support member is formed with a chamfer, which is upwardly slanted from the operation position toward the non-operation position, at a contact portion where the rubber spring and the guide support member mutually contact with each other. On the basis of a slide guide action carried out through the two chamfers, the mount of the guide support member on the chamfers and the detachment of the guide support member from the chamfers can be smoothly performed. With this construction, the slide operation of the circuit board can be smoothly performed.

According to the present invention, as described above, the upward and downward movement of the key top is guide-supported through the guide support member for supporting the two link members to be mutually rotatable. The switching member on which the guide support member is mounted is slidable disposed, whereby the key top can be kept at the operation position when the key operation is carried out, and the key top is located at the non-operation position lower than the operation position during transport. Therefore, a keyswitching device is provided that can keep the key operation performance at a high level while effectively thinning the device and improving its portability. Therefore, it is remarkably effectively usable for word processing devices.

BRIEF DESCRIPTION OF THE DRAWINGS

Preferred embodiments of the present invention are described in detail with reference to the following drawings wherein.

DETAILED DESCRIPTION OF PREFERRED EMBODIMENTS

A keyswitch device according to the present invention will be described hereunder in detail on the basis of preferred embodiments of this invention with reference to the drawings. First, the construction of the keyswitch according to a first embodiment will be described with reference to FIGS. 1 to 5.

Figure 1:
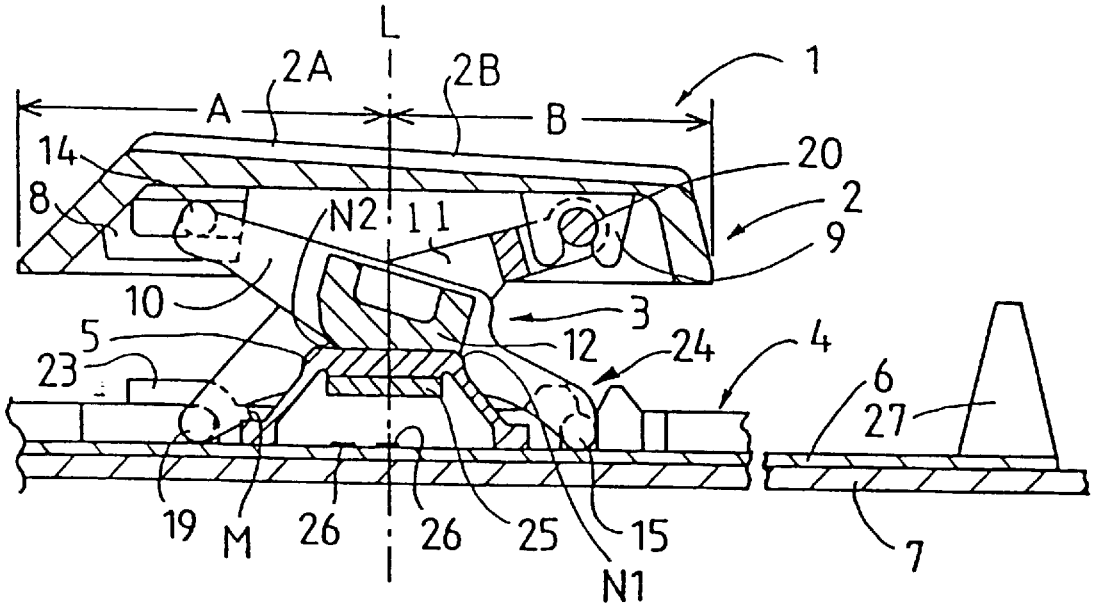
FIG. 1 is a cross-sectional view showing a keyswitch device according to a first embodiment when a key top is located at an operation position.

In FIG. 1, the keyswitch device 1 basically comprises a key top 2, a guide member 3 serving as a guide support member for guiding an upward and downward movement of the key top 2 while keeping the key top 2 horizontal, a holder member 4 for holding the guide member 3 in cooperation with the key top 2, a circuit board 6 to which the rubber spring 5 is fixed below the guide member 3, which is disposed below the holder member 4, and a support plate for supporting the lower surface of the circuit board 6.

The key top 2 is formed of ABS resin or the like, and characters, symbols, etc. are printed on the upper surface of the key top 2 to specify the key top 2. The key top 2 is divided into a front portion 2A (left-hand portion in FIG. 1) and a rear portion 2B (right-hand portion in FIG. 1) with respect to a perpendicular reference line L passing through a pivot shaft 16, wherein the front position is positioned closer to an operator. The pivot shaft 16 supports the first link member 10 and the second link member 11 constituting the guide member 3, to be mutually movable and is provided on the first link member 10. The length A of the front portion 2A is set to be longer than the length B of the rear portion 2B. A pair of elongated groove-shaped first holding portions 8 (only one of the first holding portions 8 is illustrated in FIG. 1) is formed on the back surface of the front portion 2A of the key top 2. Each first holding portion 8 holds each first sliding pin 14 formed in the first link member 10 so that the first sliding pin 14 is slidable in a horizontal direction as described later. On the back surface of the rear portion 2B are formed a pair of circular hole-shaped second holding portions (only one of the second holding portions 9 is illustrated in FIG. 1). Each second holding portion 9 holds a second holding pin 20 formed in the second link member 11 so that the second holding pin 20 is rotatable.

The guide member 3 is constructed by supporting the first link member 10 and the second link member 11 so as to be mutually rotatable. Each of the first link member 10 and the second link member 11 are described with reference to FIGS. 2 and 3.

Figure 2:
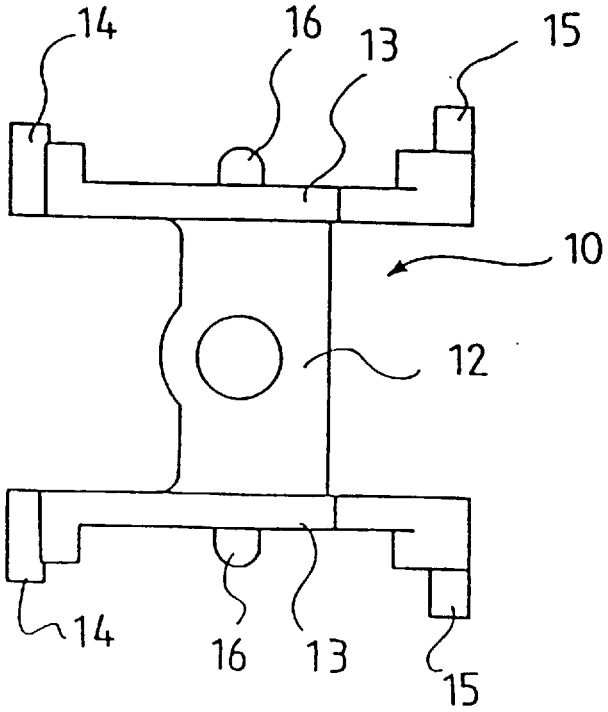
FIG. 2 is a plan view showing one link member.

First, the construction of the first link member 10 is described with reference to FIG. 2. The first link member 10 is preferably formed of polyacetal resin or the like and has a substantially "H"-shape in plan view. The first link member 10 comprises a base portion 12 and a pair of plate portions 13, which are formed at both sides of the base portion 12. The first sliding pin 14 is provided at one end (left-hand end in FIG. 2) of each plate portion 13 so as to extend outwardly, and the first holding pin 15 is provided at the other end (right-hand end in FIG. 2) of each plate portion 13 so as to extend outwardly. As described above, each first sliding pin 14 is slidably held by the first holding portion 8 formed in the front portion 2A of the key top 2, and each second holding pin 15 is rotatably held by a fourth holding portion 24 formed in the holder member 4. The pivot shaft 16 is provided substantially at the central position of each plate portion 13 so as to project outwardly. Each of the pivot shafts 16 is pivotally supported by a pivot hole 21 formed in each plate portion 18 of the second link member 11 as described later.

Figure 3:
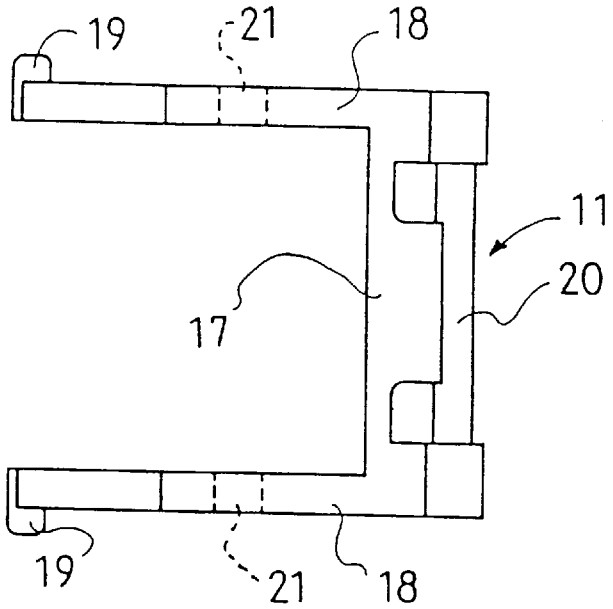
FIG. 3 is a plan view showing the other link member.

Next, the construction of the second link member 11 is described with reference to FIG. 3. Like the first link member 10, the second link member 11 is preferably formed of polyacetal resin or the like, and it has a substantially U-shape in plan view. The second link member 11 comprises a base portion 17 and a pair of plate portions 18 formed at both sides of the base portion 17. The second sliding pin 19 is provided at one end (left-hand end in FIG. 3) of each plate portion 18 so as to project outwardly, and the second holding pin 20 is provided between the other ends (right-hand ends in FIG. 3). As described below, each second sliding pin 19 is slidably held by a third holding portion 23 formed in the holder member 4, and the second holding pin 20 is rotatably held by the second holding portions 9 formed in the rear portion 2B of the key top 2. A pivot hole 21 is formed in each plate portion 18 in substantially the central portion thereof, and each pivot shaft 16, which is projectingly formed in each plate portion 13 of the first link member 10, is pivotally supported in each pivot hole 21. Furthermore, holding groove M (see FIG. 1 wherein only the holding groove M formed in one plate portion 18 of the second link member 11 is illustrated) is formed near each second sliding pin 19 of each plate portion 18. As described later, a pair of stop portions 5C, either provided on the rubber spring 5 or the printed circuit board 6, are engagedly inserted into the holding grooves M when the circuit board 6 is slid, whereby the rubber spring 5 and hence the circuit board 6 are held in place by the holding grooves M.

As described above, the guide member 3 is constructed by rotatably inserting the pivot shafts 16 of the first link member 10 into the pivot holes 21 of the second link member 11, and the respective first link member 10 and the second link member 11 are moved so as to be mutually opened and closed. The following four distances are set to equal to one another: the distance from the center of the pivot shaft 16 of the first link member 10 to the first sliding pin 14; the distance from the center of the pivot shaft 16 of the first link member 10 to the center of the first holding pin 15; the distance from the center of the pivot hole 21 of the second link member 11 to the second holding pin 20; and the distance from the center of the pivot hole 21 of the second link member 11 to the center of the second sliding pin 19.

Next, the holder member 4 of the keyswitch device 1 is described with reference to FIGS. 1 and 4. Like the key top 2, the holder member 4 is preferably formed of ABS resin or the like and is provided for each keyswitch device 1. Accordingly, when the keyswitch device 1 according to this embodiment is applied to a keyboard equipped with plural keyswitches, respective holder members 4 are integrally formed in correspondence to the respective keyswitch devices 1 on the entire keyboard.

The holder member 4 is provided with a securing opening 22. The rubber spring 5, which is fixed on the circuit board 6, is slidable in the securing opening 22 as described later. A pair of third holding portions 23 are formed at the left-hand corners of FIG. 4 at two corners of the securing opening 22. Each third holding portion 23 is formed in an elongated shape so as to confront each first holding portion 8 of the key top 2 and holds the second sliding pin 19 of the second link member 11 slidably. Furthermore, a pair of fourth holding portions 24 are formed at the right-hand corners of FIG. 4 in the holder member 4. Each fourth holding portion 24 is formed in a partially-circular hole shape with a slotted opening, so as to face the second holding portion 9 of the key top 2, and holds the first holding pin 15 of the first link member 10 rotatably. The securing opening 22 preferably has a substantially rectangular shape. However, both the side end edges (both right and left side end edges) of the securing hole 22 in a sliding direction of the rubber spring 5 are shaped in an arcuate shape that corresponds to the shape of the rubber spring 5 so that no obstruction occurs during the sliding operation of the rubber spring 5.

Next, the circuit board 6 is described with reference to FIGS. 1, 4 and 5. The circuit board 6 comprises a flexible circuit board, in which a prescribed circuit pattern is preferably formed on a polyethylene terephthalate (PET) film or the like, or comprises a rigid circuit board in which a circuit pattern is preferably formed on a sheet-phenol, glass epoxy resin or the like. The lower surface of the circuit board 6 is supported on a support plate 7 and is slidable on the support plate 7. That is, the holder member 4 and the support plate 7 are mutually secured to each other at plural areas by "caulking" or fastening, for example by screws, with a clearance set to be larger than the thickness of the circuit board 6 formed between both the members. As a result, the circuit board 6 is slidable on the support plate 7 within the clearance formed between the holder member 4 and the support plate 7.

Figure 4:
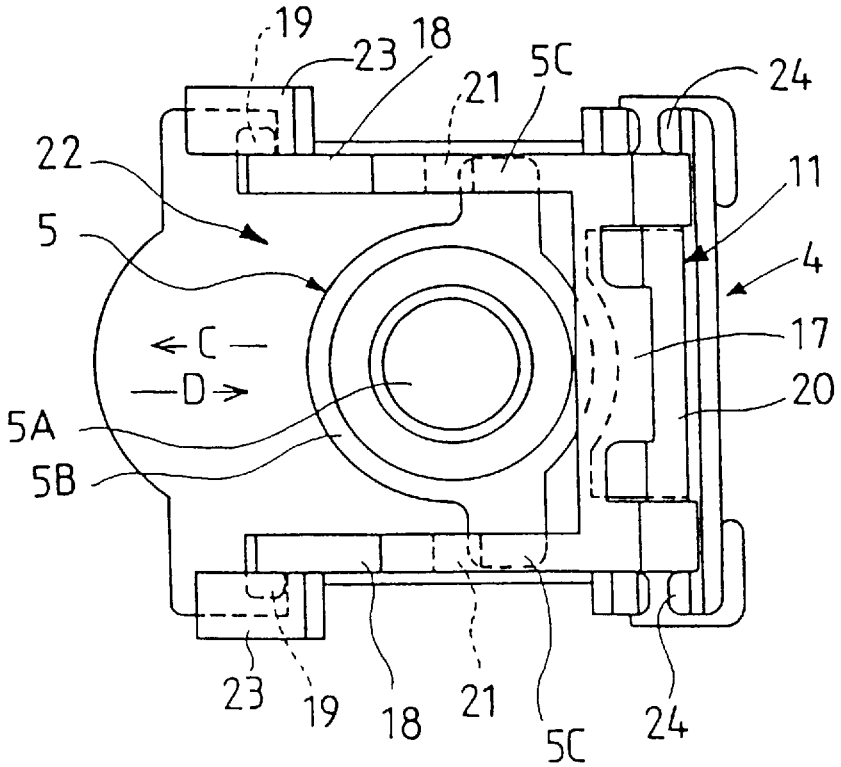
FIG. 4 is a bottom view showing the relationship between a holder member and a rubber spring at the operation position of the key top before the rubber spring is slid.

As shown in FIGS. 1 and 4, the rubber spring 5 is fixedly secured onto the circuit board 6 below a portion where the first link member 10 and the second link member 11 are pivotally supported. The rubber spring 5 is preferably formed of elastic rubber material, such as silicon rubber, EPDM or the like, and comprises a conical dome portion 5A, an outer rim or edge portion 5B formed around the dome portion 5A and two stopper portions 5C extending from the edge portion 5B (see FIG. 4). An electrode 25, movable with respect to the circuit board 6, is fixed to the inner upper wall of the dome portion 5A, and the base portion 12 of the first link member 10 is mounted at the apex of the dome portion 5A. With this construction, the guide member 3, comprising the first link member 10 and the second link member 11, is elastically supported through the dome portion 5A of the rubber spring 5. Since the rubber spring 5 is fixed onto the circuit board 6, it is slid together with the circuit board 6 interlockingly with the slide operation of the circuit board 6. This point will be described later. A chamfer portion N1 is preferably formed on the periphery of the upper end edge of the dome portion 5A and guides the guide member 3 smoothly in cooperation with a chamfer portion N2 formed at the side end (left end in FIG. 1) of the base portion 12 of the first link member.

Furthermore, a pair of fixed electrodes 26 are formed on the circuit board 6 in correspondence to the movable electrode 25 on the dome portion 5A of the rubber spring 5. The fixed electrodes 26 are mutually shortcircuited by the movable electrode 25 when the key top 2 is pressed down as described later, thereby performing a switching operation. As shown in FIG. 1, the fixed electrodes 26 are formed slightly deviated to the left of the perpendicular L with respect to the movable electrode 25. This is because the first sliding pin 14 of the first link member 10 and the second sliding pin 19 of the second link member 11 are slid in the first holding portion 8 and the third holding portion 23 respectively when the key top 2 is pressed down. The movable electrode 25 of the rubber spring 5 is also seated and contacts with each fixed electrode 26 while slightly shifted to the left side in FIG. 1, whereby the fixed electrodes 26 are short-circuited to each other at the central portion of the movable electrode 25 during switching time.

Furthermore, an operation knob 27 is mounted on the circuit board 6 spaced from the keyswitch device 1 and is operated when the circuit board 6 is slid. As shown in FIG. 5, a positioning projection 28 is formed at both sides of the operation knob 27 (in FIG. 5, only one positioning projection 28 is illustrated). The positioning projection 28 is selectively aligned with and engagedly inserted into one of four positioning grooves 29A, 29B, 29C and 29D, which are formed at both confronting side edges (seen as upper and lower side edges in FIG. 5 with only the upper side edge illustrated in FIG. 5) of an operation hole 29 formed in the holder member 4 in correspondence to a movable range of the operation knob 27. With this construction, the circuit board 6 can be positioned to any position at multi-stages relative to the holder member 4 when the circuit board 6 is slid between the holder member 4 and the support plate 7 with the operation knob 27. Accordingly, the rubber spring 5 is slidably shifted together with the circuit board 6 interlockingly with the sliding motion of the circuit board 6. So, the positional relationship between the rubber spring 5 and the guide member 3 can be altered by engagedly positioning the positioning projection 28 of the operation knob 27 into any one of the positioning grooves 29A–29D. This point will be described later.

Figure 5:
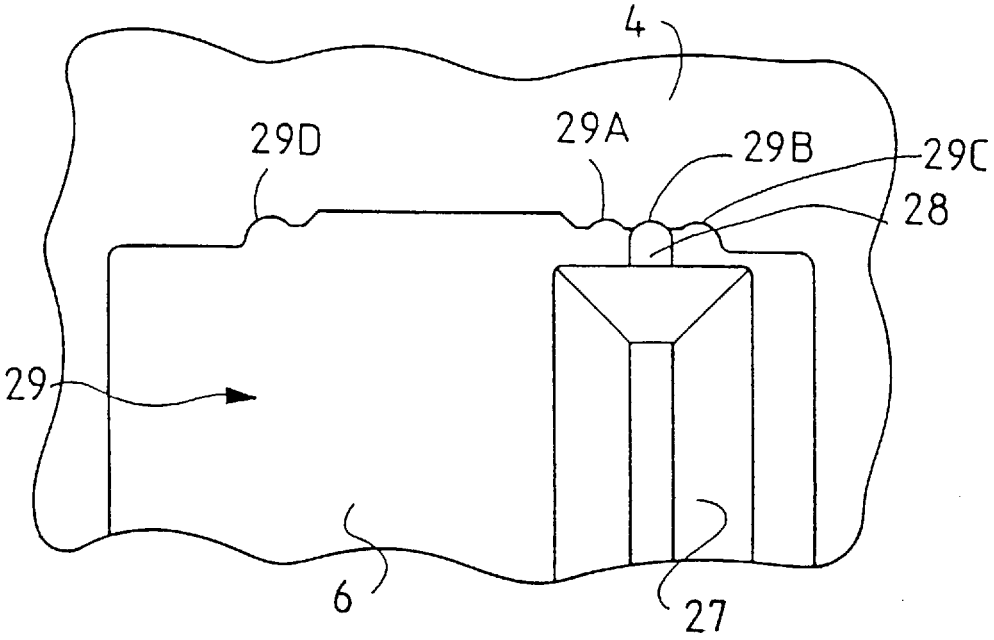
FIG. 5 is a partial plan view showing an engagement structure of an operation knob.
Figure 8:
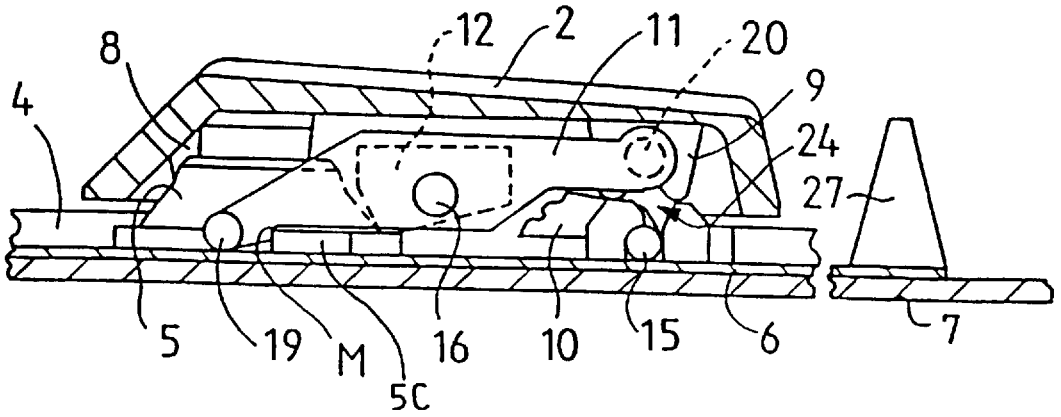
FIG. 8 is a partial cross-sectional view showing a state of the keyswitch device at the non-operation position of the key top after the rubber spring is slid.
Figure 9:
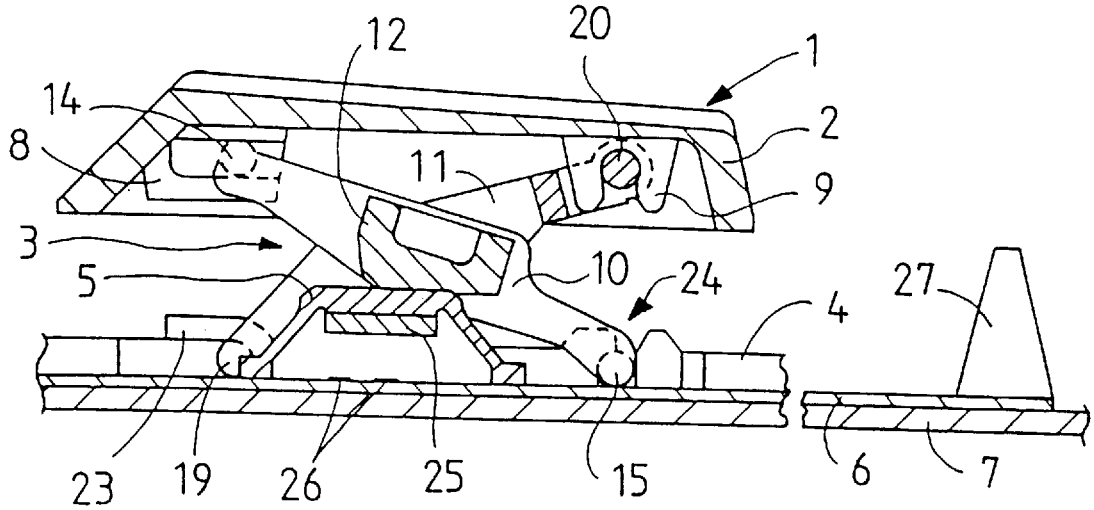
FIG. 9 is a partial cross-sectional view showing the keyswitch when the contact area between the rubber spring and the guide member is set to be smaller than usual to change the operation characteristic of the key top.
Figure 10:
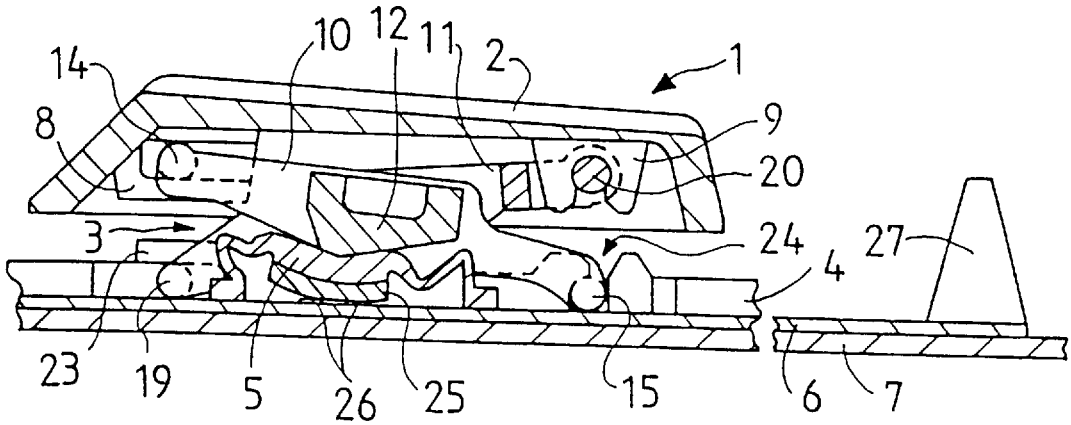
FIG. 10 is a partial cross-sectional view showing the keyswitch device showing the state when the key top shown in FIG. 9 is pressed.
Figure 11:
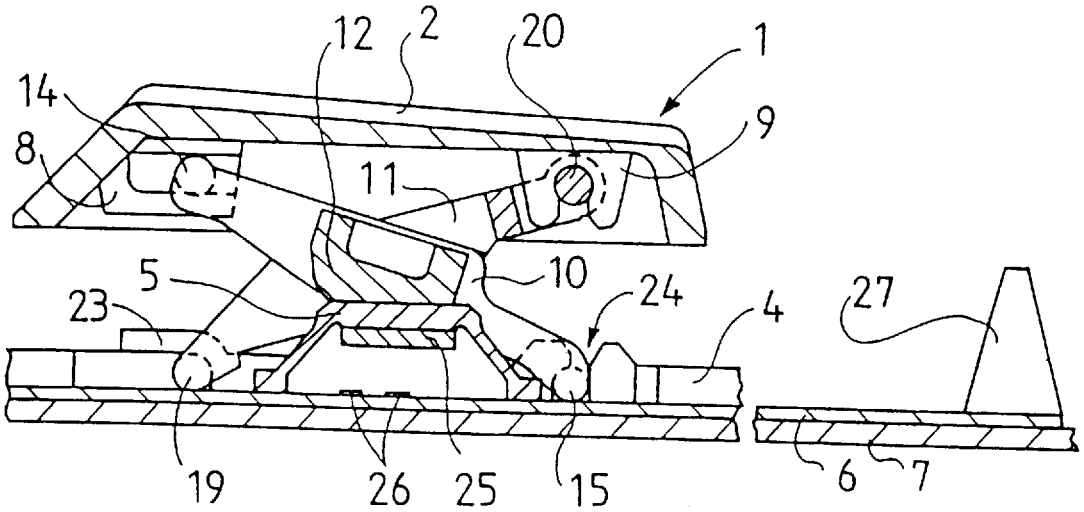
FIG. 11 is a partial cross-sectional view showing the keyswitch device when the contact area between the rubber spring and the guide member is set to be larger than usual to change the operation characteristic of the key top.
Figure 12:
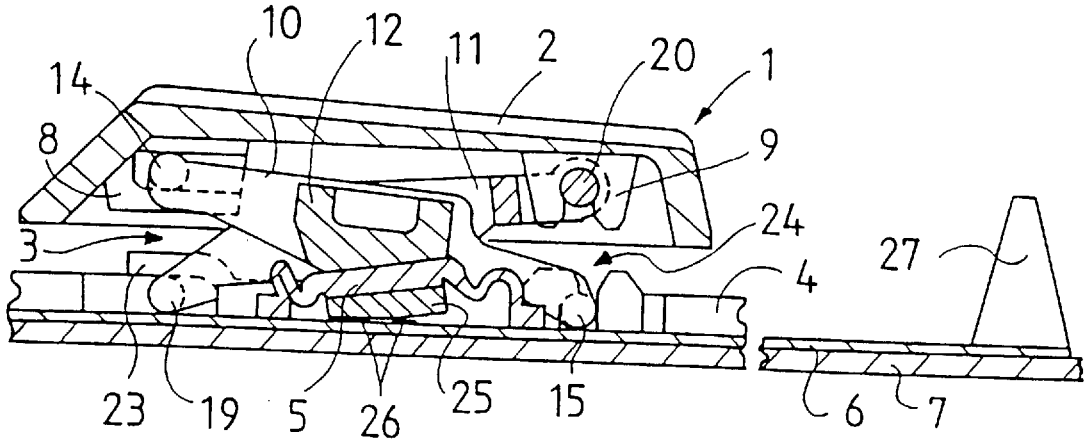
FIG. 12 is a partial cross-sectional view showing the keyswitch device showing the state when the key top shown in FIG. 11 is pressed.

In FIG. 5, the positioning projection 28 of the operation knob 27 is positioned and engagedly inserted into the positioning groove 29B. In this state, the relationship between the respective members constituting the keyswitch device 1 is set to such a relationship as shown in FIGS. 1 and 4. Furthermore, the relationship between the respective members constituting the keyswitch device 1 when the positioning projection 28 is positioned and engagedly inserted into the positioning groove 29A is set to such a relationship as shown in FIGS. 9 and 10. Likewise, the relationship between the respective members when the positioning projection 28 is positioned and engagedly inserted into the positioning groove 29C is set to such a relationship as shown in FIGS. 11 and 12. Furthermore, the relationship between the respective members when the positioning projection 28 is positioned and engagedly inserted into the positioning groove 29D is set to such a relationship as shown in FIG. 8.

Next, a method of fabricating the keyswitch device 1 thus constructed will be described. First, in a state where the circuit board 6 to which the rubber spring 5 is fixed is interposed between the support plate 7 and the holder member 4, each support plate 7 and the holder member 4 are mutually jointed to each other by "caulking" or fastening as described above while maintaining a clearance between both the members. At this time, the circuit board 6 is disposed to be slidable between the support plate 7 and the holder member 4. Thereafter, the pivot shaft 16 of the first link member 10 is pivotally supported in the pivot hole 21 of the second link member 11 to fabricate the guide member 3. Next, each second sliding pin 19 of the second link member 11 is engaged with the third holding portion 23 of the holder member 4. Further, each first holding pin of the first link member 10 is snapped into the fourth holding portion 24 of the holder member 4. With this operation, the guide member 3 is coupled to the holder member 4.

After the guide member 3 is coupled to the holder member 4 as described above, the key top 2 is disposed above the guide member 3, and each first sliding pin 14 of the first link member 10 is engagedly inserted into the first holding portion 8 formed in the front portion 2A of the key top 2. At the same time, the second holding pin 20 of the second link member 11 is snapped into the second holding portion 9 formed in the rear portion 2B of the key top 2. With this operation, the keyswitch device 1 is fabricated. When the keyswitch device 1 is fabricated as described above, the base portion 12 of the first link member 10 is mounted on the dome portion 5A of the rubber spring 5 so that the key top 2 is upwardly urged by the elastic force of the rubber spring 5 together with the guide member 3 and held at a non-depressed position shown in FIG. 1. At this time, the operation knob 27 is engaged with the positioning groove 29B.

Figure 6:
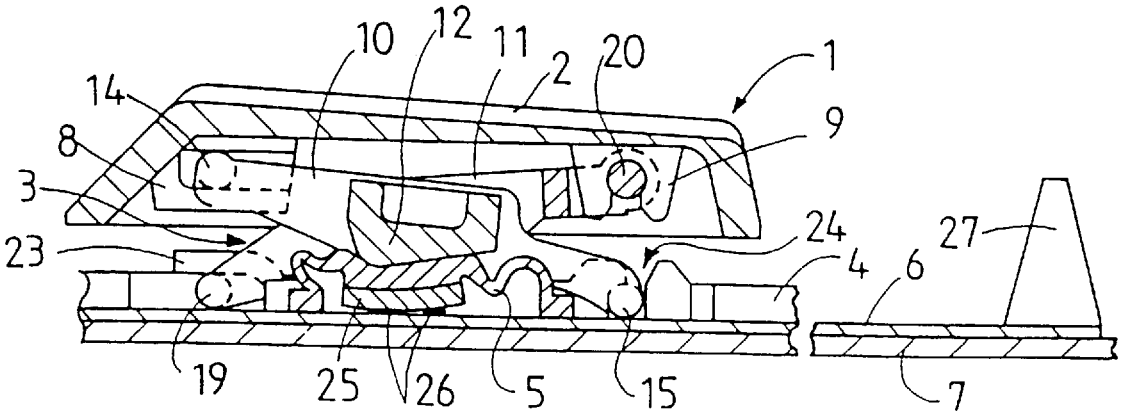
FIG. 6 is a partial cross-sectional view showing a keyswitch device showing a state where the key top is pressed.

Next, the switching operation of the keyswitch device 1 thus constructed is described with reference to FIGS. 1 and 6. FIG. 1 is a cross-sectional view showing the key-switch device 1 in a state where the key top is not pressed. In the non-depressed state of the key top 2, the positioning projection 28 of the operation knob 27 is assumed to be aligned with and engagedly inserted into the positioning groove 29B as shown in FIG. 5.

When the key top 2 is depressed from the state shown in FIG. 1, each first sliding pin 14 of the first link member 10 of the guide member 3 is slid to the left side in the first holding portion 8, and the first holding pin 15 is rotated counterclockwise in the fourth holding portion 24. At the same time, the second holding pin 20 of the second link member 11 in the guide member 3 is rotated clockwise in the second holding portion 9, and the second sliding pin 19 is slid to the left side in the third holding portion 23. At this time, the key top 2 is shifted downwardly while kept in a horizontal state regardless of the press position of the key top 2 by a cooperation action between each first link member 10 and the second link member 11.

Following the downward shift of the key top 2, the base portion 12 of the first link member 10 gradually presses the dome portion 5A of the rubber spring 5. When the pressing force exceeds a fixed limit, the dome portion 5A is seated on the circuit board 6 with click. Through the seating of the rubber spring 5, the movable electrode 25, which is fixed to the inner upper wall of the dome portion 5A, short-circuits the respective fixed electrodes 26 formed on the circuit board 6 and is switched on, whereby the on-switching operation is performed.

Upon release of the press of the key top 2, the base portion 12 of the first link member 10 is upwardly urged through the elastic force (restoring force) of the rubber spring 5. At this time, each first sliding pin 14 of the first link member 10 is slid to the right side in the first holding portion 8, and the first holding pin 15 is rotated clockwise in the fourth holding portion 24. At the same time, the second holding pin 20 of the second link member 11 of the guide member 3 is rotated counterclockwise in the second holding portion 9, and the second sliding pin 19 is slid to the right side in the third holding portion 23. Following this motion, the dome portion 5A of the rubber spring 5 is gradually returned to its original state. The movable electrode 25 is moved away from each fixed electrode through the above process and is switched to an off-state, thereby performing an off-switching operation. The key top 2 is returned to the original non-depressed state shown in FIG. 1 through the elastic force of the rubber spring 5. At this time, as during depression, the key top 2 is upwardly shifted while being maintained in the horizontal state by the cooperative action between each first link member 10 and the second link member 11.

Figure 13:
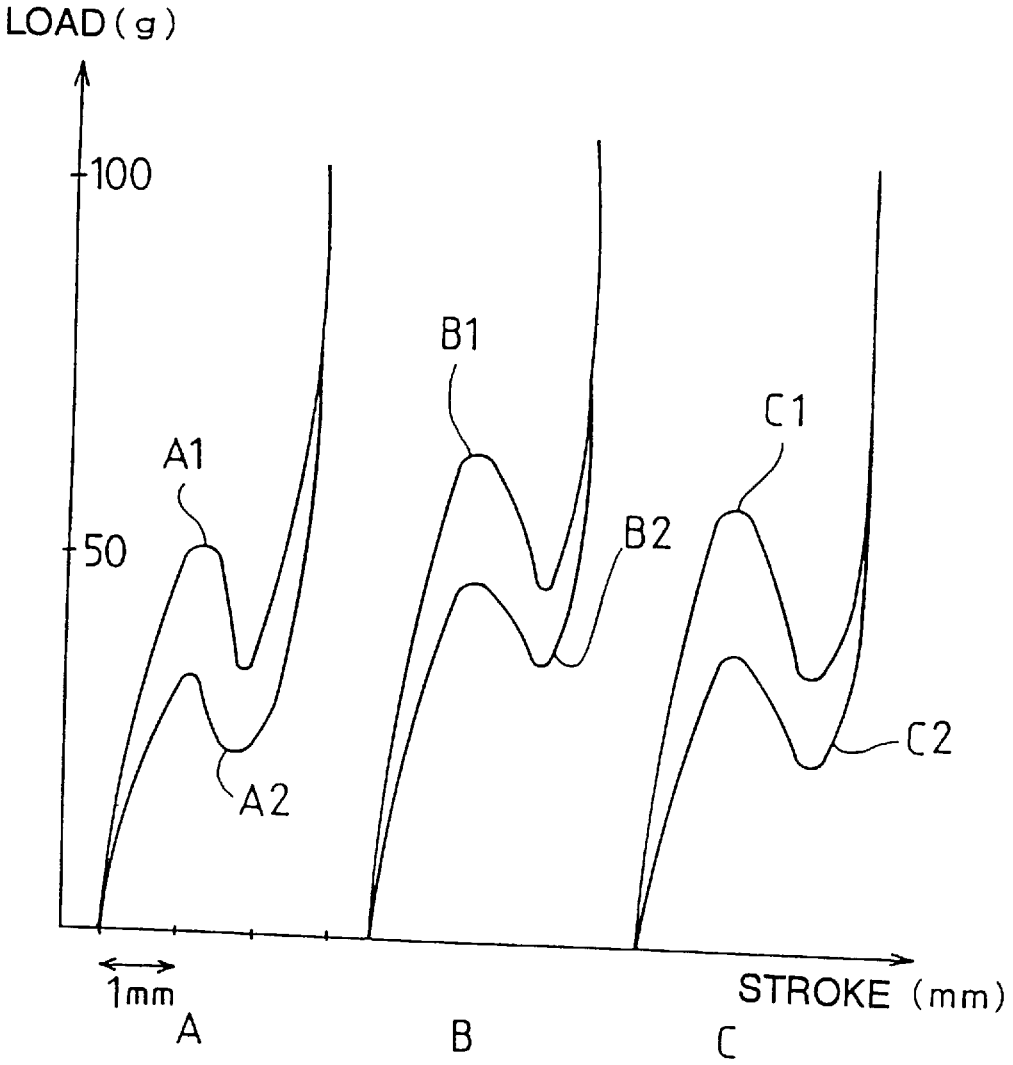
FIG. 13 is a graph showing an operation curve representing the relationship between a press load of the key top and a stroke of the key top at the operation time of the keyswitch device.

An operation curve of the keyswitch device 1 at the on-switching time and the off-switching time as described above is represented by the operation curve B in FIG. 13. Here, FIG. 13 is an operation curve representing the relationship between a pressing-load of the key top 2 and a stroke of the key top 2 at the operation time of the keyswitch device 1. In FIG. 13, the ordinate represents a pressing-load (g) of the key top 2, and the abscissa represents a stroke amount (mm) of the key top 2.

In the operation curve B of FIG. 13, a curve B1 shows variation of the pressing-load and the stroke amount at the press time (i.e. pressing or depression) of the key top 2, and the curve B2 represents variation of the pressing-load and the stroke amount at the press-release time of the key top 2. The operation curve B as described above shows the variation when the switching operation is carried out in the state where the positional relationship between the rubber spring 5 and the base portion 12 of the first link member 10 of the guide member 3 is set to an ordinary state (a state where the positioning projection 28 of the operation knob 27 is positioned and engagedly inserted into the positioning groove 29B). It is apparent that the switching operation is carried out with a prescribed operation characteristic. When the positional relationship between the rubber spring 5 and the base portion 12 of the first link member 10 varies, the pressing force applied to the rubber spring 5 through the base portion 1 and the pressing direction are varied. So, the operation curve in this case varies like the operation curves A, C. This point will be described later.

Figure 7:
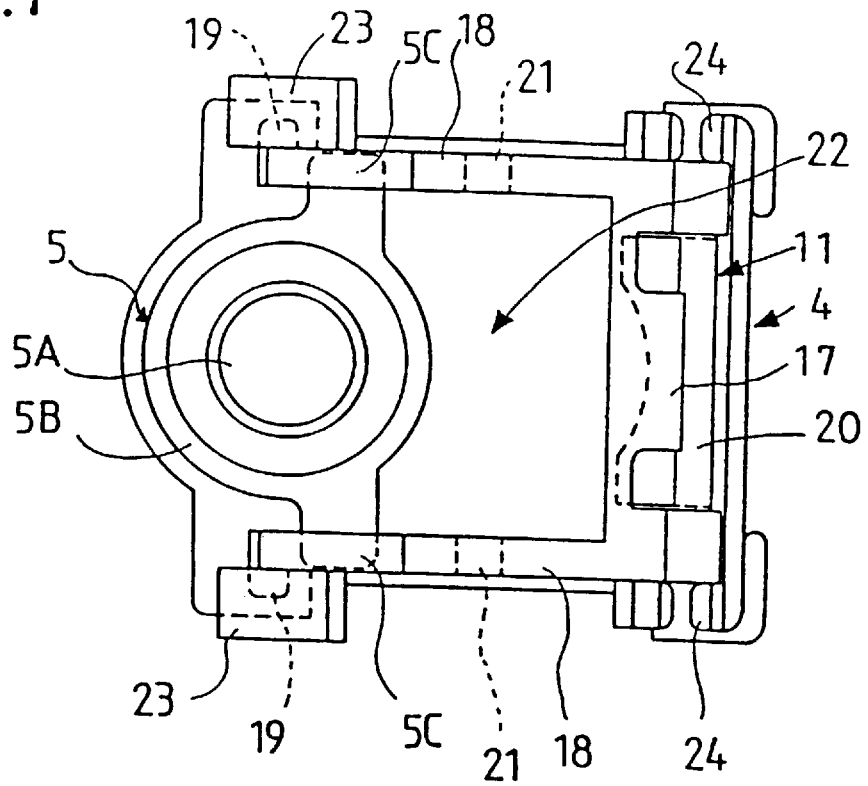
FIG. 7 is a bottom view showing the relationship between a holder and a rubber spring at the non-operation position of the key top after the rubber spring is slid.

Next, an operation when the circuit board 6 is slid in the opening direction of each first link member 10, and second link member 11 through the operation knob 27 to lower the height of the key top 2 for the purpose of improving portability of the keyswitch device 1 thus constructed is described with reference to FIG. 7 and 8. Here, FIG. 7 schematically shows the relationship between the holder member 4 and the rubber spring 5 at the non-operation position of the key top 2 after the rubber spring is slid. FIG. 8 is a cross-sectional view showing schematically a state of the keyswitch device 1 at the non-operation position of the key top 2 after the rubber spring is slid. It is assumed that the holder member 4 and the rubber spring 5 are in the state shown in FIG. 4 before the sliding operation of the circuit board 6.

First, the circuit board 6 is shifted in a direction as indicated by an arrow C of FIG. 4 through the operation knob 27 between the holder member 4 and the support plate 7, and the positioning projection 28 is slid until it is positioned and engagedly inserted into the positioning groove 29D. During the sliding of the circuit board 6, the dome portion 5A of the rubber spring 5 is gradually detached from the base portion 12 of the first link member 10, and when the base portion 12 abuts against the conical wall portion of the dome portion 5A, the first link member 10 and the second link member 11 of the guide member 3, which is upwardly urged by the elastic force of the rubber spring 5, are mutually folded up. Following this operation, the height of the key top 2 is gradually lowered from the state shown in FIG. 1. When the base portion 12 of the first link member 10 is completely separated from the dome portion 5A of the rubber spring 5, the first link member 10 and the second link member 11 are mounted on the circuit board while being completely folded up as shown in FIG. 8. At the same time, the key top 2 is located at the lowest position because no elastic force of the rubber spring 5 is applied to the key top 2.

When the base portion 12 of the first link member 10 is completely separated from the dome portion 5A of the rubber spring 5, each stopper 5C is engagedly inserted into each holding groove M formed in the second link member 11. The stoppers 5C are either provided on the rubber spring 5 or on the printed circuit board 6. With this arrangement the first link member 10 and the second link member 11 are kept in the folded-up state. Accordingly, the key top 2 is kept at the lowest position, and the key top 2 can be reliably prevented from being shaken even when the key top 2 is vibrated upwardly and downwardly when the keyswitch device 1 is carried.

Furthermore, when the base portion 12 of the first link member 10 is completely separated from the dome portion 5A of the rubber spring 5, the rubber spring 5 is accommodated below the front portion 2A of the key top 2. As described above, when the rubber spring 5 is slid to the non-operation position of the key top 2 together with the circuit board 6, the rubber spring 5 is slid toward the front portion 2A, which is designed to be longer than the rear portion 2B, and is accommodated at the lower side of the front portion 2A. Therefore, the rubber spring 5 can be surely prevented from being accommodated while abutting against the key top 2 and thus being deformed. Furthermore, both the side end edges (end edges at both the right and left sides in FIG. 4) of the securing opening 22 are designed in an arcuate shape that conforms to the shape of the rubber spring 5, so that the rubber spring 5 can be smoothly slid in the securing opening 22 without abutting against the holder member 4.

When the keyswitch device 1 is used, in order to return the key top 2 to the operation position, according to the operation inverse to the above operation, the circuit board 6 is shifted in a direction as indicated by an arrow D of FIG. 4 (right direction of FIG. 1) through the operation knob 27, which is slid until the positioning projection 28 is positioned and engagedly inserted into the positioning groove 29B. During the sliding operation of the circuit board 6, the engagement between the holding groove M and the stopper portion 5C is first released, and the dome portion 5A of the rubber spring 5 gradually moves under the lower side of the base portion 12 of the first link member 10 and finally is mounted at the apex portion of the dome portion 5A. With this operation, the folded first link member 10 and the second link member 11 are returned to their original states, and the height of the key top 2 gradually increases, so that it is returned to the original operation position of FIG. 1. When the dome portion 5A of the rubber spring 5 moves under the lower side of the first link member 10 as described above, the first link member 10 is smoothly slide-guided through the cooperation of the chamfer portions N1 and N2 because the chamfer portion N1 is formed on the periphery of the upper end edge of the dome portion 5A and the chamfer portion N2, which meets the chamfer portion N1, is formed at the end portion of the base portion 12.

Next, alterations of the operation characteristics of the key top 2 by adjusting the positional relationship between the rubber spring 5 and the guide member 3 in the keyswitch device 1 at a multi-stage are described with reference to FIGS. 9 to 12. FIG. 9 is a cross-sectional view showing the keyswitch device 1 when the operation characteristic of the key top 2 is altered by reducing the contact area between the rubber spring 5 and the guide member 3 to a smaller value than usually. FIG. 10 is a cross-sectional view of the keyswitch device 1 showing a state where the key top 2 shown in FIG. 9 is pressed down. FIG. 11 is a cross-sectional view showing the keyswitch 1 when the operation characteristic of the key top 2 is altered by increasing the contact area between the rubber spring 5 and the guide member 3 to a larger value than usual. FIG. 12 is a cross-sectional view showing the keyswitch device 1 showing a state where the key top 2 shown in FIG. 11 is pressed down. It is assumed that at an initial stage the positioning projection 28 of the operation knob 27 is positioned and engaged with the positioning groove 29B, and the positional relationship between the rubber spring 5 and the guide member 3 is set to the usual state shown in FIG. 1. In the following description, the above description is referred to for those elements having the same construction as described in FIG. 1, etc. Thus, the description thereof is omitted. The same construction is described by affixing the same reference numerals thereto.

When the operation characteristic of the key top 2 is altered, the circuit board 6 is first slid on the support plate 7 through the operation knob 27, and the positioning projection 28 of the operation knob 27 is shifted from the positioning groove 29B to the positioning groove 29A to be positioned and engaged. The positional relationship between the rubber spring 5 and the guide member 3 at this time is shown in FIG. 9. In the positional relationship between the rubber spring 5 and the guide member 3 shown in FIG. 9, the contact area between the base portion of the first link member 10 of the guide member 3 and the dome portion 5A of the rubber spring 5 is smaller in comparison with the usual case shown in FIG. 1, and the contact portion is located at the right side of FIG. 9.

In such a contact relationship, the pressing force applied to the dome portion 5A of the rubber spring 5 by the first link member 10 and the pressing direction are changed when the key top 2 is pressed. As a result, when the key top 2 is pressed to perform the on-switching operation shown in FIG. 10 and when the press of the key top 2 is released to perform the off-switching operation, some variation occurs in the operation characteristic of the key top 2 as shown in the operation curve A of FIG. 13. Here, in the operation curve A, the curve Al represents variation of the press load and the stroke amount when the key top 2 is pressed. The curve A2 represents the press load and the stroke amount when the press of the key top 2 is released. In comparison between the operation curve A and the operation curve B, the switching operation is performed with a smaller pressing force in the operation curve A than in the operation curve B. Thus, a lighter key operation feeling can be obtained as the key operation characteristic.

When the key operation characteristic is set to a different one from the key operation characteristic obtained in the operation curve A, the circuit board 6 is slid on the support plate 7 through the operation knob 27 to shift the positioning projection 28 of the operation knob 27 from the positioning groove 29A to the positioning groove 29C. The positional relationship between the rubber spring 5 and the guide member 3 in this state is shown in FIG. 11. In the positional relationship between the rubber spring 5 and the guide member 3 shown in FIG. 11, the contact area between the base portion 12 of the first link member 10 in the guide member 3 and the dome portion 5A of the rubber spring 5 is larger than the usual case of FIG. 1, and the contact portion is located at a slight left side as shown in FIG. 11.

In such a contact relationship, the pressing force applied to the dome portion 5A of the rubber spring 5 by the base portion 12 of the first link member 1 and the pressing direction are different from those of FIG. 9 when the key top 2 is pressed. As a result, when the key top 2 is pressed to perform the on-switching operation as shown in FIG. 12, and when the press of the key top 2 is released to perform the off-switching operation, variation of the operation characteristic of the key top 2 appears as shown by the operation curve C of FIG. 13. Here, in the operation curve C, the curve C1 represents variation of the pressing load and the stroke amount when the key top 2 is pressed, and the curve C2 represents variation of the pressing load and the stroke amount when the press of the key top 2 is released. In the comparison between the operation curve C and the operation curve B, the operation curve C and the operation curve B have substantially the same key operation characteristic. However, the switching operation in the operation curve C is performed with a stronger click than that in the operation curve B. Accordingly, a significant key operation feeling (a strong click) can be obtained as the key operation characteristic in the operation curve C.

As described above, a positioning groove is selected from the positioning grooves 29A to 29C, and accordingly the positioning projection 28 of the operation knob 27 is engagedly inserted into the selected positioning groove. Therefore, the key operation characteristic of the key top 2 can be freely altered, and it can be set to an operation characteristic that meets a user's favorite key operation feeling to perform the key operation.

Figure 14:
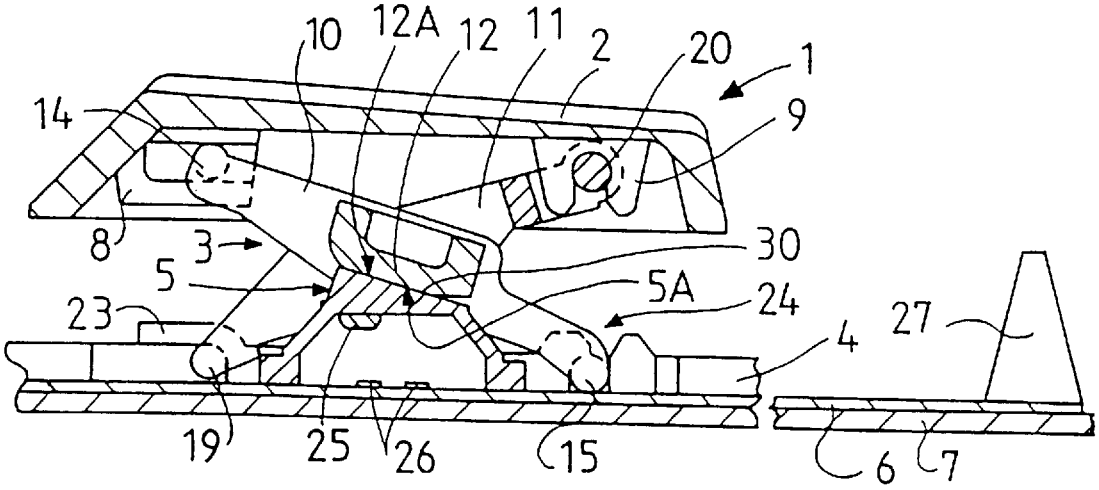
FIG. 14 is a partial cross-sectional view showing the keyswitch device according to a second embodiment when the key top is located at the operation position.

Next, the keyswitch device 1 according to a second embodiment of the present invention will be described with reference to FIG. 14. FIG. 14 is a cross-sectional view showing the keyswitch device 1 when the key top 2 is located at the operation position. This embodiment is characterized by a construction including a slant portion 30 formed at the apex portion of the dome portion 5A in the rubber spring 5 designed in consideration of the slide direction of the circuit board 6. So, when the circuit board 6 is slid, the rubber spring 5 can be smoothly shifted from the operation position to the non-operation position and from the non-operation position to the operation position. The other elements are constructed the same as in the keyswitch device 1 of the first embodiment. Accordingly, the same members as the keyswitch device 1 of the first embodiment are represented by the same reference numerals, and the description thereof is omitted. Therefore, only the characteristic construction will be described below.

In FIG. 14, the apex portion of the dome portion 5A in the rubber spring 5 is formed with a slant portion 30 that is upwardly slanted in such a direction that the circuit board 6 is slid from the operation position of the key top 2 to the non-operation position through the operation knob 27. The movable electrode 25 provided on the inner upper wall of the dome portion 5A is located at a left position from the central portion of the inner upper wall. This construction is designed in consideration of the following factor. That is, since the rubber spring 5 is not pressed from the upper side in the vertical direction, but is pressed in a slanted direction through the slant portion 30, the movable electrode 25 is downwardly moved, while slightly making an arcuate motion when the rubber spring 5 is pressed, and then comes into contact with the fixed electrodes 26 on the circuit board 6.

Furthermore, as is apparent from the comparison in FIGS. 1, 9 and 11, the base portion 12 of the first link member 10 of the guide member 3 is formed with a slant surface 12A that meets the slant surface of the slant portion 30. With this construction, the base portion 12 is mounted in close contact with the slant portion 30 of the rubber spring through the slant surface 12A.

If the circuit board 6 is shifted from the operation position of the key top 2 to the non-operation position through the operation knob 27 when the keyswitch device 1 is carried, the slant portion 30 of the dome portion 5A of the rubber spring 5 is moved along the slant surface 12A of the base portion 12 of the first link member 10, whereby the rubber spring 5 can be smoothly slid toward the non-operation position. Conversely, if the circuit board 6 is slid from the non-operation position of the key top 2 toward the operation position through the operation knob 27 when the keyswitch device 1 is subjected to a keying operation, the slant portion 30 of the dome portion 5A of the rubber spring 5 is moved while moving under the slant surface 12A of the base portion 12 of the first link member 10. At this time, the slant portion 30 and the slant surface 12A have the same slant direction, and the slant portion 30 is smoothly moved along the slant surface 12A, so that the rubber spring 5 can be smoothly slid toward the operation position.

As described above, the rubber spring 5 is formed with the slant portion 30 that is upwardly slanted from the operation position of the key top 2 to the non-operation position, and the base portion 12 of the first link member 10 of the guide member 3 is formed with the slant surface 12A, which meets the slant surface of the slant portion 30. With this construction, the rubber spring 5 can be smoothly slid through the cooperative action of the slant portion 30 and the slant surface 12A whenever it is slid from the operation position of the key top 2 toward the non-operation position, and case it is slid from the non-operation position to the operation position.

As described above in detail, according to the keyswitch device 1 of this embodiment, the key top 2 is disposed so as to be movable upwardly and downwardly on the holder member 4 through the guide member 3, which supports the first link member 10 and the second link member 11 so as to be mutually rotatable. The circuit board 6, which is fixed to the rubber spring 5 on which the base portion 12 of the first link member 10 of the guide member 3 is mounted, is designed to be slidable on the support plate 7 in the opening and closing direction of the first link member 10 and the second link member 11 between the operation position and the non-operation position of the key top 2 through the operation knob 27. Therefore, a stem portion for slide-guiding the key top 2 is not required for the holder member 4. Thus, the thinning of the keyswitch device 1 can be easily performed. Furthermore, when the keyswitch device 1 is carried, the circuit board 6 is slid to the non-operation position to shift the rubber spring 5 to the non-operation position where it is separated from the guide member 3, thereby releasing the urging of the guide member 3 by the rubber spring 3 and folding up the first link member 10 and the second link member 11, so that the height of the key top 2 can be reduced.

Furthermore, the stopper portion 5C is formed in the rubber spring 5, and the holding groove M is formed in the second link member 11. The stopper portion 5C is engagedly inserted into the holding groove M when the circuit board 6 is slid to the non-operation position. Therefore, the key top 2 can be kept at its non-operation position. Accordingly, the key top 2 can be reliably locked at the non-operation position when it is carried, and it can be reliably prevented from being shaken during transport.

Furthermore, when the key top 2 is divided into the front portion 2A and the rear portion 2B with respect to the perpendicular L passing the pivot shaft 16 of the first link member 10 of the guide member 3, as described above, the rubber spring 5 is positioned and accommodated below the front portion 2A, which is longer than the rear portion 2B, in a state where the circuit board 6 is slid to the non-operation position of the key top 2. Therefore, the rubber spring 5 can be efficiently accommodated below the key top 2 while effectively using the space formed below the front portion 2A. With this construction, the rubber spring 5 can be accommodated below the key top 2 without being supplied with any load and thus being deformed. Therefore, the lifetime thereof can be lengthened while keeping the prescribed characteristics inherent to the rubber spring 5 for a long time.

In the keyswitch device 1 of the first embodiment, the chamfer portion N1 is formed on the periphery of the upper end edge of the dome portion 5A of the rubber spring 5, and the chamfer portion N2, which meets the chamfer portion N1, is formed at the end portion of the base portion 12 of the first link member 1. Therefore, when the rubber spring 5 is returned to the transport state to the original key operable state, the base portion 12 of the first link member 10 can be smoothly upwardly slideguided through the cooperation between the chamfer portions N1 and N2. Furthermore, in the keyswitch device 1 of the second embodiment, the rubber spring 5 is formed with the slant portion 30 upwardly slanted from the operation position of the key top 2 toward the non-operation position. The base portion 12 of the first link member 10 of the guide member 3 is formed with the slant surface 12A that meets the slant surface of the slant portion 30. Therefore, the rubber spring 5 can be smoothly slid through the cooperation action between the slant portion 30 and the slant surface 12A whenever it is slid from the operation position of the key top 2 toward the non-operation position and when it is slid from the non-operation position toward the operation position.

The present invention is not limited to the embodiments described above, and various improvements and modifications may be made without departing from the subject matter of the present invention. For example, in each embodiment, the movable electrode 25, which is fixed to the inner upper wall of the dome portion 5A of the rubber spring 5, and the fixed electrodes 26 formed on the circuit board 6 are brought into contact with each other when the key top 2 is pressed. However, it is apparent that the same effect as each embodiment can be obtained by disposing a so-called membrane comprising two switching sheets and a spacer interposed therebetween on the lower surface of the holder member 4 and forming a press portion on the inner upper wall of the dome portion 5A.

Furthermore, the number of operation knobs is not limited to one, and an operation knob 27 may be individually provided on both ends of the keyboard.

What is claimed is:

1. A keyswitch assembly comprising:

a key;

a base plate disposed beneath said key;

a key support supporting said key for perpendicular movement with respect to said base plate, said key support pivotally coupled between said key and said base plate;

a printed circuit board having an electrical contact and mounted beneath said key support; and a switch comprising a resilient spring having an upper surface and a lower surface on which an electrical contact is disposed, said electrical contact for making electrical connection with said electrical contact of said printed circuit board upon depression of said key, said switch being fixed to said printed circuit board and positionable in at least an operating position beneath said key support wherein said key support contacts and compresses said upper surface of said spring upon depression of said key to make electrical connection and a non-operating position removed from beneath said key support wherein upon depression of said key no electrical connection is made.

2. The keyswitch assembly of claim 1 wherein said key support comprises a scissors-type linkage including a first lever having two ends, a first end connected to said key and a second end connected to said base plate, and a second lever having two ends, a first end connected to said key and a second end connected to said base plate, said first and second levers being pivotally secured about a pivot axis, said pivot axis being positioned over said switch in the operating position and spaced from said switch in the non-operating position.

3. The keyswitch assembly of claim 2 wherein at least one of the first and second levers has a base portion positioned at said pivot axis that forms a bearing surface that bears on said switch, said base portion having an outer surface facing said switch and slanted in a direction to facilitate movement of said switch between the operating position and the non-operating position.

4. The keyswitch assembly of claim 3 wherein said switch comprises a resilient spring having an upper surface slanted in the same direction as said slanted surface of said key support.

5. The keyswitch assembly of claim 2 wherein said first end of said first lever is pivotally connected to said key, said second end of said first lever is slidably connected to said base plate, said first end of said second lever is slidably connected to said key, and said second end of said second lever is pivotally connected to said base plate.

6. The keyswitch assembly of claim 1 wherein said upper surface of said resilient spring is slanted upwardly toward said key to facilitate movement of said switch between the operating position and the non-operating position.

7. The keyswitch assembly of claim 1 wherein said key is positioned at a first height in the operating position and at a second height lower than the first with respect to the base plate in the non-operating position.

8. The keyswitch assembly of claim 7 wherein said switch is positionable in an intermediate position wherein said key support contacts said switch and said key is positioned at a third height lower than the first height and higher than the second height with respect to the base plate.

9. The keyswitch assembly of claim 1 further comprising an operation assembly coupled to said printed circuit board for moving said switch between the operating position and the non-operating position.

10. The keyswitch assembly of claim 9 wherein said operation assembly comprises a movable lever and said base plate includes a plurality of positioning grooves, wherein said movable lever selectively engages one of said positioning grooves to select the operating position and the non-operating position.

11. The keyswitch assembly of claim 10 wherein said movable lever selectively engages one of said positioning grooves to change a pressing force required to depress said key in the operating position.

12. The keyswitch assembly of claim 1 further comprising a stop fixed to said printed circuit board and said key support has a complementary holding member, wherein said holding member engages said stop when said switch is moved into the non-operating position to limit displacement of said switch with respect to said key.

13. The keyswitch assembly of claim 1 wherein said switch has a stop and said key support has a complementary holding member, wherein said holding member engages said stop when said switch is moved into the non-operating position to prevent said key from displacing vertically with respect to said base plate.

14. The keyswitch assembly of claim 1 wherein said key has a longitudinal length formed of a first portion and a second portion, said second portion being longer than said first portion and said key support being equally spaced under said key with respect to the first and second portions, wherein in the non-operating position said switch is disposed under said second portion.

15. The keyswitch assembly of claim 14 wherein said key support comprises at least one lever having one end pivotally coupled to said key under said first portion and another end slidably coupled to said base plate under said second portion.

16. The keyswitch assembly of claim 15 wherein said key is positioned on a keyboard such that said second portion is disposed closer to an operator than said first portion.

17. A keyswitch assembly comprising:

a key;

a base plate disposed beneath said key;

a key support supporting said key for perpendicular movement with respect to said base plate, said key support pivotally coupled between said key and said base plate;

a printed circuit board having an electrical contact and mounted beneath said key support; and a switch having an electrical contact for making electrical connection with said electrical contact of said printed circuit board upon depression of said key, said switch being fixed to said printed circuit board and positionable in at least an operating position beneath said key support wherein said key support contacts and compresses said switch upon depression of said key to make electrical connection and a non-operating position removed from beneath said key support wherein upon depression of said key no electrical connection is made, and wherein said switch comprises a rubber dome-like spring having an outer arcuate surface and said base plate has an outer arcuate edge, wherein when said switch is positioned in the non-operating position, said outer arcuate surface of said spring is adjacent to said outer arcuate edge of said base plate.

18. The keyswitch assembly of claim 1 wherein said key support expands and contracts about a pivot axis and, upon depression of said key, said key support slides in a direction perpendicular to said pivot axis and said key support is fixed in a direction parallel to said pivot axis.

19. The keyswitch assembly of claim 18 wherein said printed circuit board and said switch fixed thereto is movable in a direction perpendicular to said pivot axis.

20. The keyswitch assembly of claim 19 wherein said key is a component on a keyboard and said pivot axis is perpendicular to an operator.

21. The keyswitch assembly of claim 18 wherein said key support is pivotally fixed to said key and said base plate on one side of said pivot axis and is slidably fixed to said key and said base plate on an opposed side of said pivot axis.

22. The keyswitch assembly of claim 18 wherein at least one of the electrical contacts is offset in a direction perpendicular to said pivot axis prior to depression of said key.

23. A keyswitch assembly comprising:

a key;

a base plate disposed beneath said key;

a key support supporting said key for perpendicular movement with respect to said base plate, and comprising first and second levers pivotally joined and forming a scissors-type mechanism with a pivot axis; and a switching member slidably disposed between said base plate and said key wherein said key is positionable in at least a first position at a first height, wherein said switching member is disposed beneath said key and directly under said key support so that upon depression of said key said key support pivots and bears on said switching member to actuate switching, a second position at a second height lower than the first height with respect to the base plate, wherein said switching member is disposed beneath said key and adjacent to said key support so that no switching is actuated, and a third position wherein said key support contacts said switching member and said key is positioned at a third height lower than the first height and higher than the second height with respect to the base plate.

24. The keyswitch assembly of claim 23 wherein said first lever has a first end pivotally connected to said key and a second end slidably connected to said base plate, and said second lever has a first end slidably connected to said key and a second end pivotally connected to said base plate.

25. A keyswitch assembly comprising:

a key;

a base plate disposed beneath said key;

a key support supporting said key for perpendicular movement with respect to said base plate, and comprising first and second levers pivotally joined and forming a scissors-type mechanism with a pivot axis; and a switching member slidably disposed between said base plate and said key in at least a first position, wherein said switching member is disposed beneath said key and directly under said key support so that upon depression of said key said key support pivots and bears on said switching member to actuate switching, and a second position, wherein said switching member is disposed beneath said key and adjacent to said key support so that no switching is actuated, wherein at least one of said first and second levers has a base portion positioned at said pivot axis that forms a bearing surface that bears on said switching member, said base portion having an outer surface facing said switching member and slanted in a direction to facilitate movement of said switching member between the first and second positions, and wherein said switching member comprises a resilient spring having an upper surface slanted in the same direction as said slanted surface of said key support.

26. The keyswitch assembly of claim 23 wherein said switching member comprises a resilient spring having an upper surface upon which said key support bears in the first position and a lower surface on which said electrical contact is disposed, said switching member having a dome-like shape.

27. The keyswitch assembly of claim 26 wherein said base plate has an outer arcuate edge that matches an outer surface of said dome-like switching member and when said switching member is in the second position said outer surface of said switching member is adjacent to said outer arcuate edge of said base plate.

28. The keyswitch assembly of claim 23 further comprising an operation assembly coupled to said switching member for sliding said switching member between the first and second positions, said operation assembly comprising a movable lever, and wherein said base plate includes a plurality of positioning grooves, wherein said movable lever selectively engages one of said positioning grooves to select the position.

29. The keyswitch assembly of claim 28 wherein said switching member comprises a printed circuit board having an electrical contact and a resilient spring having an electrical contact mounted on said printed circuit board.

30. The keyswitch assembly of claim 29 wherein at least one of the electrical contacts is offset in a direction perpendicular to said pivot axis prior to depression of said key.

31. The keyswitch assembly of claim 23 wherein said switching member has a stop and at least one of said levers has a complementary holding member, wherein said holding member engages said stop when said switching member is moved into the second position to limit displacement of said switching member with respect to said key.

32. The keyswitch assembly of claim 23 wherein said switching member has a stop and at least one of said levers has a complementary holding member, wherein said holding member engages said stop when said switching member is moved into the second position to limit vertical displacement of said key with respect to said base plate.

33. The keyswitch assembly of claim 23 wherein said key has a longitudinal length formed of a first portion and a second portion, said second portion being longer than said first portion and said first and second levers being equally spaced under said key with respect to the first and second portions, wherein in the second position said switching member is disposed under said second portion.

34. The keyswitch assembly of claim 33 wherein said key support comprises at least one lever having one end pivotally coupled to said key under said first portion and another end slidably coupled to said base plate under said second portion, and said second portion is oriented toward an operator.

35. A The keyswitch of claim 23 wherein said switching member comprises a rubber dome-like spring having an outer arcuate surface and said base plate has an outer arcuate edge, wherein when said switching member is positioned in the non-operating position said outer arcuate surface is adjacent to said outer arcuate edge of said base plate.

36. The keyswitch assembly of claim 23 wherein said key support expands and contracts about a pivot axis and, upon depression of said key, said key support slides in a direction perpendicular to said pivot axis and said key support is fixed in a direction parallel to said pivot axis.

37. The keyswitch assembly of claim 36 wherein said switching member is movable in a direction perpendicular to said pivot axis.

38. The keyswitch assembly of claim 37 wherein said key is positioned on a keyboard and said pivot axis is perpendicular to an operator.

39. The keyswitch assembly of claim 36 wherein said key support is pivotally fixed to said key and said base plate on one side of said pivot axis and is slidably fixed to said key and said base plate on an opposed side of said pivot axis.

40. A keyswitch for a portable keyboard assembly comprising:

key means for pressing to actuate switching;

a base disposed beneath said key means;

key support means coupled to said key means and said base for guiding said key means for generally perpendicular movement with respect to said base;

switch means disposed beneath said key means for making an electrical connection to actuate switching upon depression of said key means, said key support means contacting and bearing on said switch means to actuate switching; and disengaging means coupled to said switch means for disengaging said switch means from contact with said key support means and allowing depression of said key means for storage, and comprising a movable lever coupled to said switch means and a plurality of positioning grooves located in said base, wherein said movable lever selectively engages one of said positioning grooves to engage and disengage said switch means.

41. The keyswitch assembly of claim 40 wherein said key support means comprises a scissors-type linkage including a first lever and a second lever, said first and second levers being pivotally secured about a pivot axis, said key support means having a slanted surface positioned over said switch means for switching actuation and spaced from said switch means during storage.

42. The keyswitch assembly of claim 41 wherein said first lever has two ends, one end pivotally connected to said key means and another end slidably connected to said base, and said second lever has two ends, one end slidably connected to said key means and another end pivotally connected to said base.

43. The keyswitch assembly of claim 41 wherein said switch means comprises a resilient spring having an upper surface slanted in the same direction as said slanted surface of said key support means.

44. The keyswitch assembly of claim 40 wherein said disengaging means allows selective adjustment of a pressing force for actuating switching by moving said movable lever with respect to said positioning grooves.

45. The keyswitch assembly of claim 40 further comprising stop means for limiting displacement of said switch means with respect to said key means during disengagement.

46. The keyswitch assembly of claim 40 wherein said key support means expands and contracts about a pivot axis and, upon depression of said key means, said key support means slides in a direction perpendicular to said pivot axis and said key support means is fixed in a direction parallel to said pivot axis.

47. The keyswitch assembly of claim 46 wherein said switch means is movable in a direction perpendicular to said pivot axis.

48. The keyswitch assembly of claim 47 wherein said key means is a component on a keyboard and said pivot axis is perpendicular to an operator.

49. The keyswitch assembly of claim 46 wherein said key support means is pivotally fixed to said key means and said base on one side of said pivot axis and is slidably fixed to said key means and said base on an opposed side of said pivot axis.

50. A method of selectively varying the height of a keyboard by adjusting the height of a key supported for generally perpendicular movement with respect to a base by a key support pivotally coupled between the key and the base, having a switch and a printed circuit board disposed beneath the key for selective electrical connection upon depression of the key, the method comprising the steps of:

positioning the switch in a first position directly beneath the key support so that, upon depression of the key to a first depressed height, the key support contacts and bears on the switch causing an electrical contact between the switch and the printed circuit board;

sliding the printed circuit board and switch generally parallel with respect to the base to a second position without closing a cover so that, upon depression of the key to a second depressed height lower than the first depressed height with respect to the base, the key support does not bear on the switch; and sliding the printed circuit board and switch generally parallel with respect to the base from the second position to the first position so that, upon depression of the key, the key support contacts and bears on the switch causing an electrical contact between the switch and the printed circuit board.

51. The method of claim 50 comprising the step of sliding the printed circuit board and the switch to an intermediate position between the first and second positions wherein, upon depression of the key to a third height lower than the first height and higher than the second height, the key support contacts and bears on the switch causing an electrical contact between the switch and the printed circuit board.

52. A keyswitch assembly comprising:

a key;

a base plate disposed beneath said key;

a key support supporting said key for perpendicular movement with respect to said base plate, said key support comprising a scissors-type linkage having a pivot axis that is pivotally coupled between said key and said base plate;

a switch assembly disposed beneath said key for actuating switching upon depression of said key; and a pressing force adjustment assembly coupled to said switch assembly for adjusting a pressing force required to depress said key and actuate switching.

53. The keyswitch assembly of claim 52 wherein said switch assembly comprises a resilient spring having an electrical contact disposed beneath said key support and a printed circuit board having an electrical contact so that to actuate switching said key is depressed and said key support bears on said resilient spring causing said electrical contacts to touch.

54. The keyswitch assembly of claim 53 wherein at least one of the electrical contacts is offset in a direction perpendicular to said pivot axis prior to depression of said key.

55. The keyswitch assembly of claim 52 wherein said pressing force adjustment assembly comprises a slidable lever that slides said switch assembly in a direction perpendicular to said pivot axis.

56. The keyswitch assembly of claim 55 wherein said slidable lever slides said switch assembly toward an operator, and wherein upon depression of said key, said key support pivots and slides toward an operator.

57. The keyswitch assembly of claim 55 wherein said pressing force adjustment assembly further comprises a plurality of grooves formed in said base plate, and wherein said slidable lever is selectively retained in one of said grooves.

58. The keyswitch assembly of claim 52 wherein said pressing force adjustment assembly adjusts a pressing force required to actuate switching by moving said switch assembly with respect to said key support.

59. The keyswitch assembly of claim 40 wherein said key means is supported by said key support means when said switch means is actuated for switching upon depression of said key means and when said switch means is disengaged from said key support means to allow depression of said key means for storage.

60. The keyswitch assembly of claim 1 wherein said key is supported by said key-support when said switch is in both said operating position and said non-operating position.

* * * * *